US007275622B2

(12) United States Patent
Hall et al.

(10) Patent No.: US 7,275,622 B2
(45) Date of Patent: Oct. 2, 2007

(54) TRACTION ELEVATOR BACK-UP POWER SYSTEM WITH INVERTER TIMING

(75) Inventors: James C. Hall, Bethlehem, PA (US); J. Werner Reinartz, Center Valley, PA (US)

(73) Assignee: Reynolds & Reynolds Electronics, Inc., Bethlehem, PA (US)

( * ) Notice: Subject to any disclaimer, the term of this patent is extended or adjusted under 35 U.S.C. 154(b) by 650 days.

(21) Appl. No.: 10/844,892

(22) Filed: May 13, 2004

(65) Prior Publication Data

US 2005/0006182 A1 Jan. 13, 2005

Related U.S. Application Data

(60) Provisional application No. 60/496,730, filed on May 15, 2003.

(51) Int. Cl.
*B66B 1/06* (2006.01)

(52) U.S. Cl. ..... 187/290; 187/277

(58) Field of Classification Search ..... 187/290, 187/296, 297, 277, 293; 307/66, 69
See application file for complete search history.

(56) References Cited

U.S. PATENT DOCUMENTS

| | | | | |
|---|---|---|---|---|
| 4,379,499 | A | 4/1983 | Nowak | |
| 5,058,710 | A * | 10/1991 | Iwasa | 187/290 |
| 5,325,034 | A | 6/1994 | Reynolds | |
| 6,315,081 | B1 * | 11/2001 | Yeo | 187/290 |
| 6,439,348 | B2 * | 8/2002 | Tajima et al. | 187/290 |
| 6,516,922 | B2 | 2/2003 | Shadkin et al. | |
| 6,631,790 | B2 | 10/2003 | Mattlar et al. | |
| 6,712,183 | B2 | 3/2004 | Otsuka et al. | |

* cited by examiner

*Primary Examiner*—Jonathan Salata
(74) *Attorney, Agent, or Firm*—Pearne & Gordon LLP

(57) ABSTRACT

A back-up power system for a traction elevator includes a power sensing device to sense a power loss or irregularity of the normal control power. An inverter timing system is connected to the power loss sensing device. The inverter timing system receives a power sensing signal from the power sensing device. A back-up power generating system communicates with the inverter timing system and generates an output to provide back-up power to the elevator system.

8 Claims, 7 Drawing Sheets

TRACTION ELEVATOR BACK-UP POWER SYSTEM WITH INVERTER TIMING

FIELD OF THE INVENTION

The present invention relates to emergency power systems and more specifically to an emergency back-up power system for a traction elevator.

BACKGROUND OF THE INVENTION

With the globalization of the elevator industry there has been a trend to standardize elevator systems worldwide. This trend is leaning toward the use of traction systems for smaller elevator applications (i.e., less floors). Previously, hydraulic elevator systems were commonly used in applications with over five landings. The trend anticipates that these applications will begin to utilize traction elevator systems. Such systems must be provided with emergency or back-up power systems that supply power not only to the controller, door operator, and valves, but also to the main drive system.

Many common back-up Universal Power Systems (UPS) use a high frequency waveform synthesis to create a near perfect three phase sine wave output waveform. This approach requires an expensive design. This approach can also cause problems for an elevator control system, as there will be high frequency noise and potentially a larger than expected number of zero crossings.

The present invention overcomes the disadvantage of the common back-up UPS by providing a stepped square wave output. Therefore, the invention provides the power required with a much simpler and less expensive design.

In addition, recent developments have lead to traction elevator systems replacing older technology, i.e., soft start systems, with new Variable Frequency Drive (VFD) technologies. VFD technology has two advantages. First, VFD technology allows a traction motor to be connected to the main power system with a low level of inrush current. Second, VFD technology allows a traction motor to run at a very low speed and at a very low power. Thus, while a typical traction motor might be a 60 hp three phase load, when running at a normal speed, the motor may only be a 2 hp load at its slowest speed. The reason for this low load is that a traction elevator system is counter weighted. The elevator's typical loading of passengers (i.e., the passenger weight) is exactly matched by the counter weight. This allows for optimal efficiency of the system. However, under most elevator conditions, an exact matching of the counter weight and the passenger load does not occur. Thus, a traction elevator will tend to drift up or down depending on this imbalance.

By continually monitoring the elevator load, the present invention is able to keep track of which direction the car would drift. When a power outage occurs, this information is available for use by the emergency back-up power system. Also, to handle the capacitive nature of the VFD, a three phase inductor system is placed between an inverter stepped square wave output stage and the VFD. This prevents the high dv/dt of the square wave from causing large load current levels.

Furthermore, unlike the hydraulic elevator systems, the traction elevator system requires that the back-up power system provide full power to the traction motor (e.g., >50 hp load at full motor speed). This requires that the back-up power system be capable of switching a high power load. In hydraulic applications, the back-up power system is not required to power the large hydraulic pump. The system is required to only power a valve that relieves the hydraulic pressure in the system thereby lowering the elevator. In the traction system, the requirement to handle high levels of normal power results in a system where the back-up power is fed in parallel to the normal control power system. This results in a need for a different system approach for sequencing the various systems so as to assure that both the back-up power and the normal control power sources are not connected to the traction elevator system simultaneously.

BRIEF SUMMARY OF THE INVENTION

The present invention continually monitors the main power provided to an elevator system. This power passes through a series of contacts in the system. Upon sensing a power loss or irregularity, a power loss sensing device will disconnect the elevator system from the main power system (i.e., line). The device will provide a signal to an inverter timing system indicating that the elevator system is on emergency power. Then, a back-up system provides a parallel power feed to the elevator system. This power will be used to recover functioning of the elevator controller, the elevator door control system, and the traction motor drive system.

As the elevator controller contains several control transformers, the back-up system is capable of supplying the first few electrical cycles (e.g., 50 milliseconds) of inrush current. In addition, as the VFD is a bridge rectifier system feeding a large amount of capacitance, the back-up system is able to provide the initial charging of the dc bus capacitors. Once the elevator electrical system has been recharged and stabilized, the elevator controller will provide an appropriate speed and direction command to the traction motor drive system.

The invention further provides for the higher power requirements and different power sequencing of the traction application. The higher power requires a fundamental change in the power system topology and requires many new components. The unique power sequencing also requires a change in logic and power connection systems.

Therefore, in accordance with one aspect of the present invention, the invention provides a back-up power system for a traction elevator comprising a power loss sensing device, where the power loss sensing device senses a power irregularity of the normal control power, an inverter timing system operatively connected to the power loss sensing device, where the inverter timing system receives a power irregularity signal from the power loss sensing device, and a back-up power generating means communicating with the inverter timing system, where the back-up power generating means generates an output to provide back-up power.

BRIEF DESCRIPTION OF THE DRAWINGS

The invention may take physical form in certain parts and arrangement of parts, a preferred embodiment of which will be described in detail in this specification and illustrated in the accompanying drawings that form a part of the specification.

DESCRIPTION OF INVENTION

Figure 1:
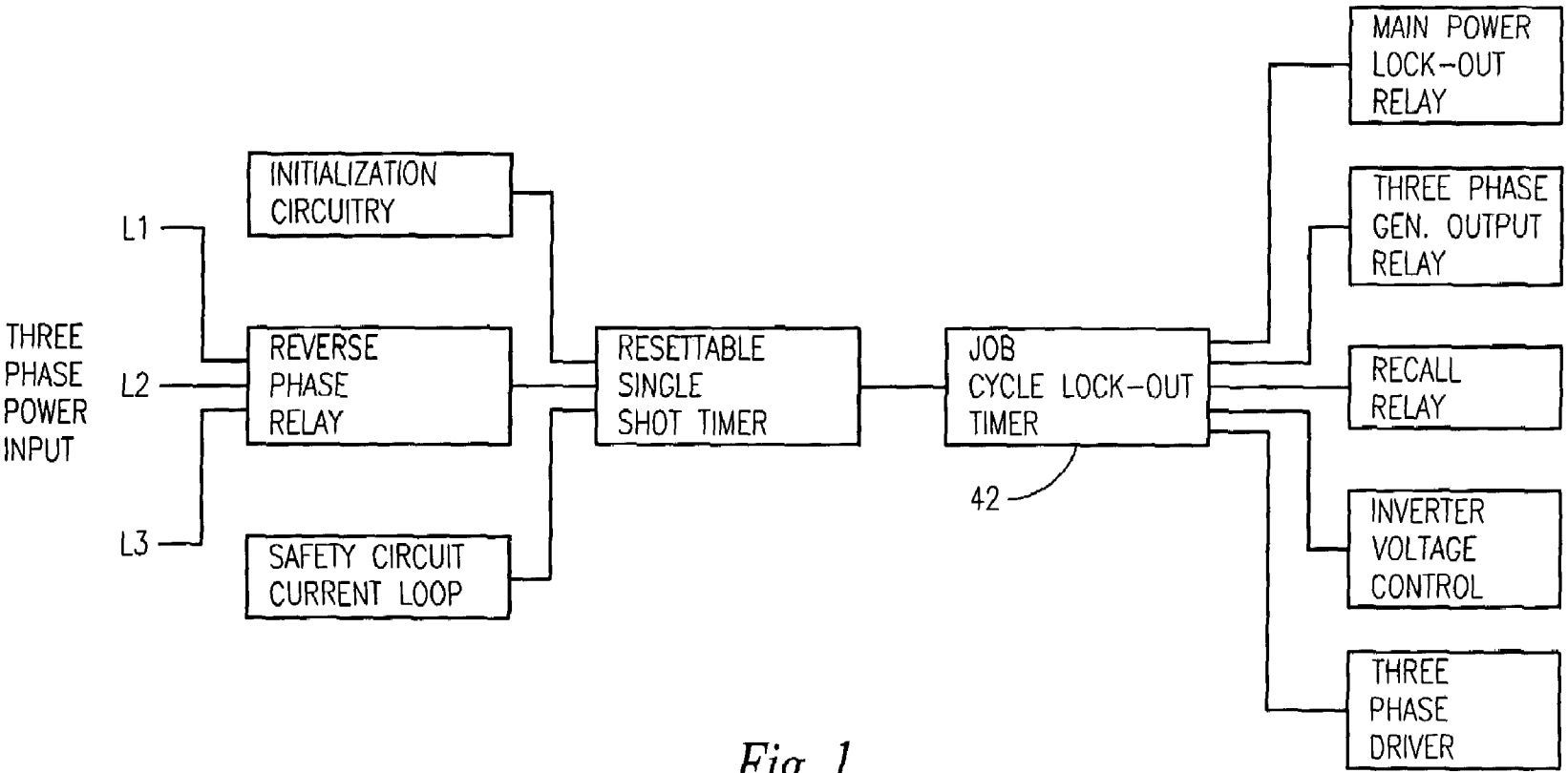
FIG. 1 is a drawing showing the timing of the present invention.
Figure 2:
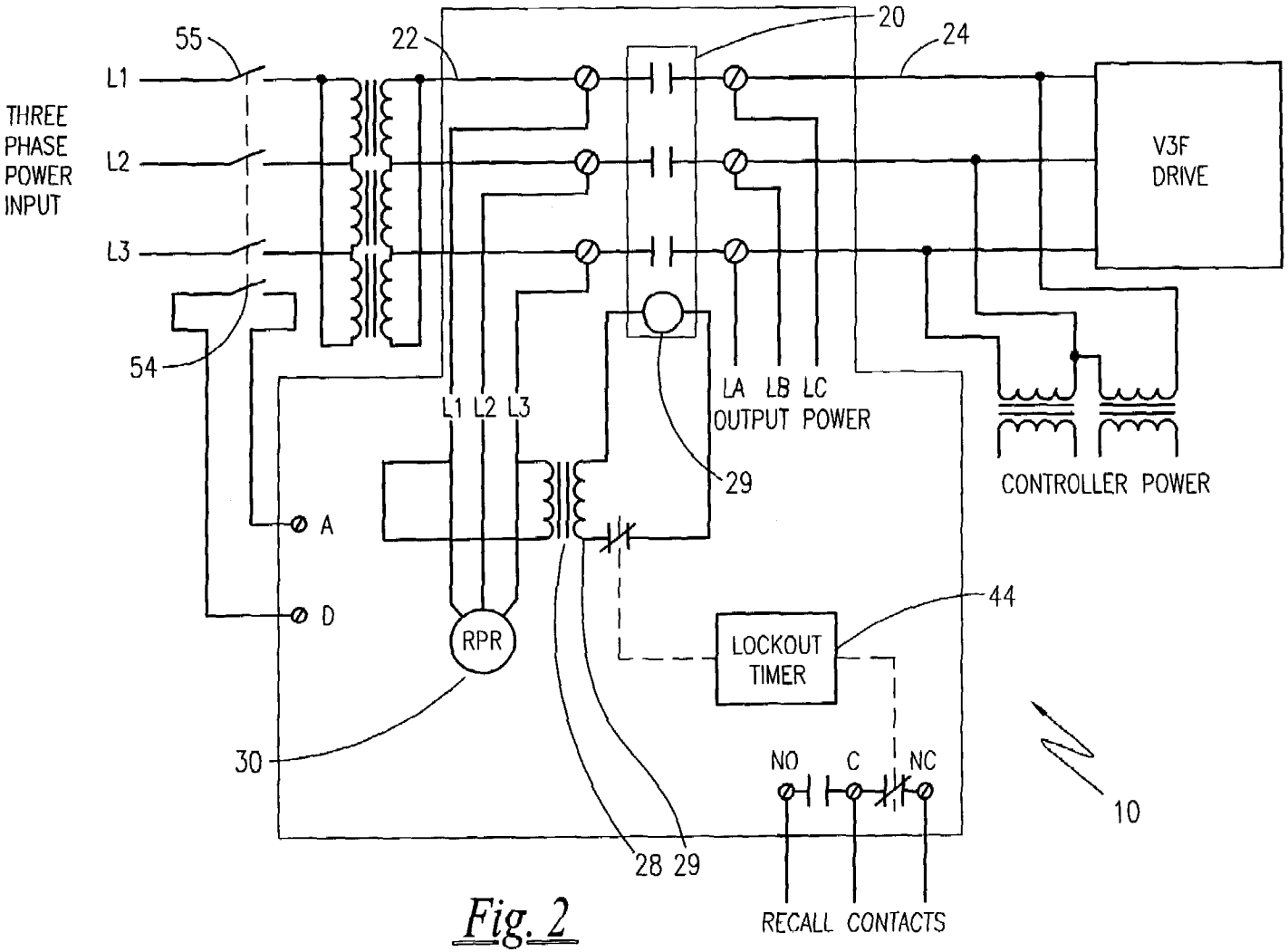
FIG. 2 is a circuit diagram of the overall connection of present invention.

Referring now to the drawings, FIGS. 1 and 2 show the overall timing and connection of the back-up power system 10. The back-up power system 10 consists of three major areas: 1) normal power control; 2) power sensing and inverter timing systems; and 3) a backup power generation system.

Figure 3:
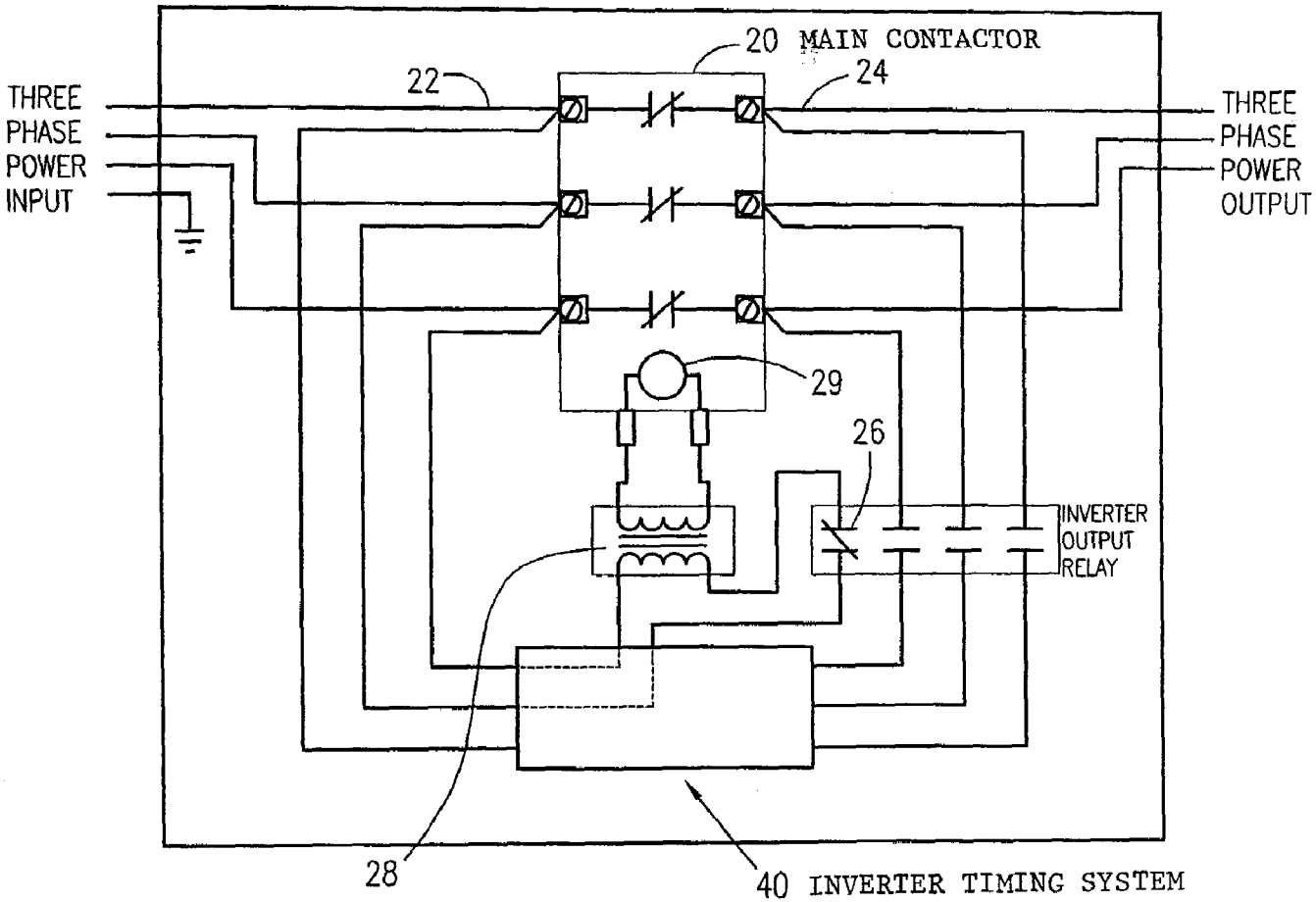
FIG. 3 is a circuit diagram of the main power control of the present invention.

Referring to FIGS. 2 and 3, normal power control is done via the main contactor 20 and supporting systems. The normal power input source is connected on the line side 22 of the main contactor 20. The elevator system load is connected on the load side 24 of the main contactor 20. Under normal power conditions, the power on the load side of the main contactor 20 is connected via a job cycle lockout timer's normally closed contact 26 sending power to the contactor coil's 29 step-down transformer 28. Operation of the job cycle lockout timer will be described in more detail below. The transformer 28 allows for a common contactor design approach for a wide range of system voltages. This design also uses normal input power to power the contactor coil 29. This approach reduces the power requirement on the inverter battery system and allows for normal system operation when the system is turned-off.

Still referring to FIGS. 2 and 3, power is sensed via a three phase reverse phase relay (RPR) 30. Upon sensing a power loss or irregularity, the present invention will open the contactor 20 thereby disconnecting the elevator system from the main power system. The RPR 30, which is connected to the line side 22 of the contactor 20, provides a signal to the inverter timing system 40 indicating that the elevator system is on emergency power.

Referring now to FIGS. 1-3, the inverter timing system 40 consists of a job cycle lock-out timer 42 and a main power lockout timer 44. Typically, emergency power units permit the elevator system to operate until either normal control power is restored or a low battery voltage condition is present. These conditions are not desirable for high power applications. The job cycle lock-out timer 42, therefore, sets a maximum amount of time that back-up power is permitted to supply power to the elevator system. This approach also optimizes the back-up power battery system design. In addition, the job cycle lock-out timer 42 assures that a full cycle has been completed before the elevator system is returned to normal control power. This allows for the operation of a full elevator cycle thereby allowing any person on the elevator to be transported to their destination prior to the elevator system switching back to normal control power. Prior systems would transfer power back and forth between normal control power and emergency power, if periodic brown-outs were to occur (e.g., every 30 seconds).

The main power lock-out timer 44 performs two functions. First, it disconnects the load from normal control power when a power irregularity is detected. Second, it will not reconnect the elevator system to normal control power until after the inverter timing system 40 is shutdown and disconnected. Therefore, the inverter timing system 40 prevents simultaneous operation of the back-up power system and normal control power.

Figure 4:
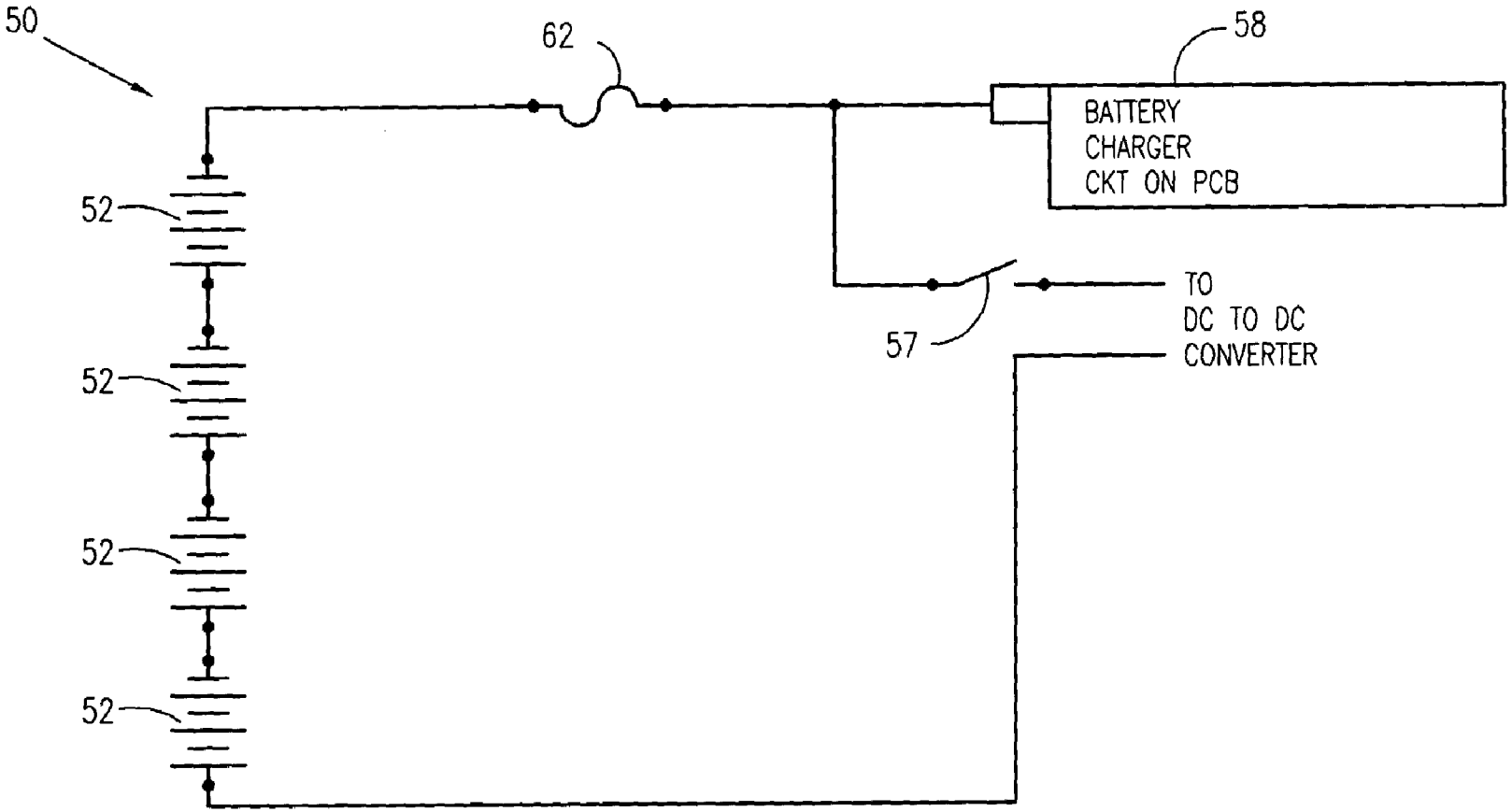
FIG. 4 is a circuit diagram of the battery power system of the present invention.
Figure 5:
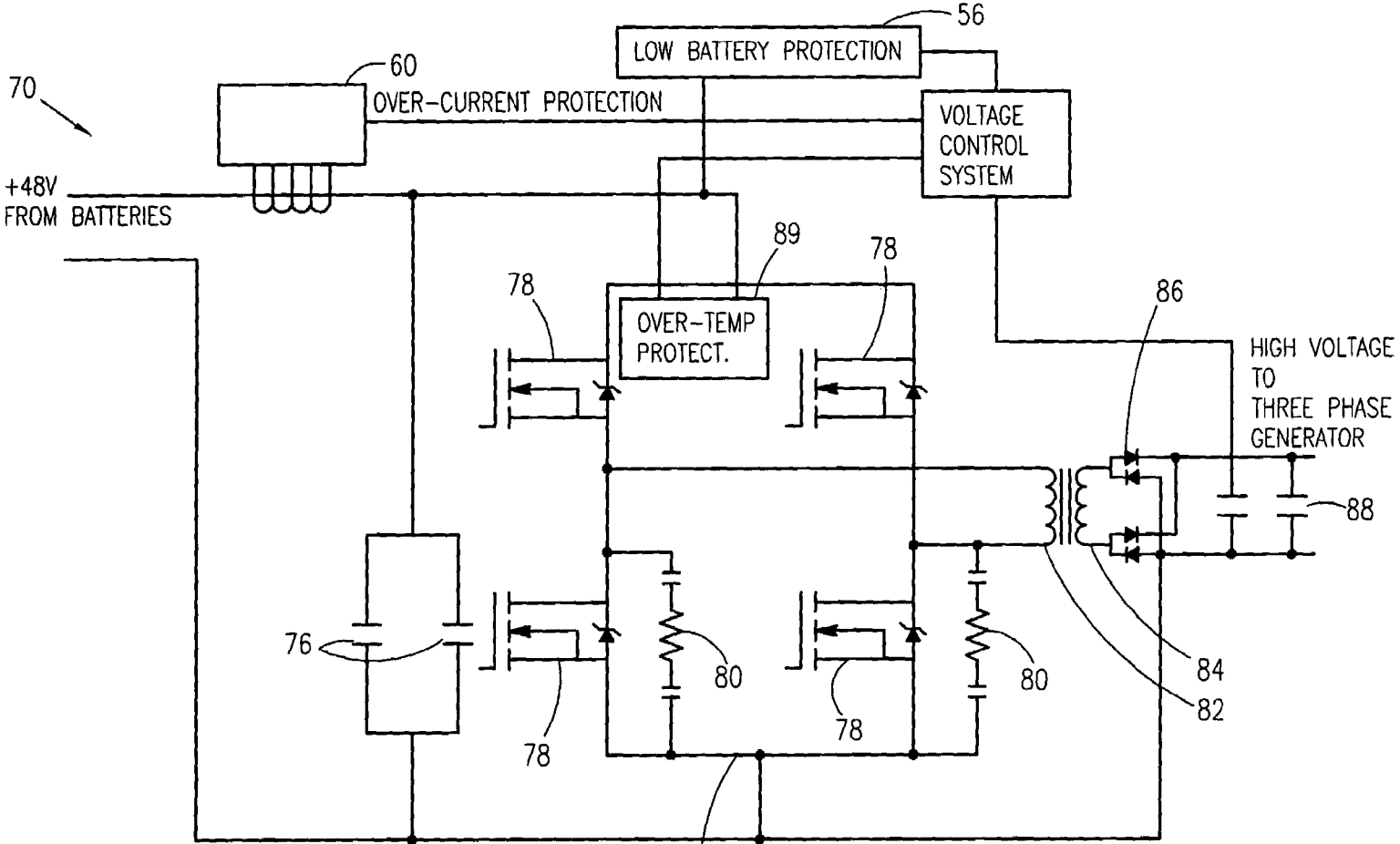
FIG. 5 is a circuit diagram of the dc/dc inverter converter of the present invention
Figure 6:
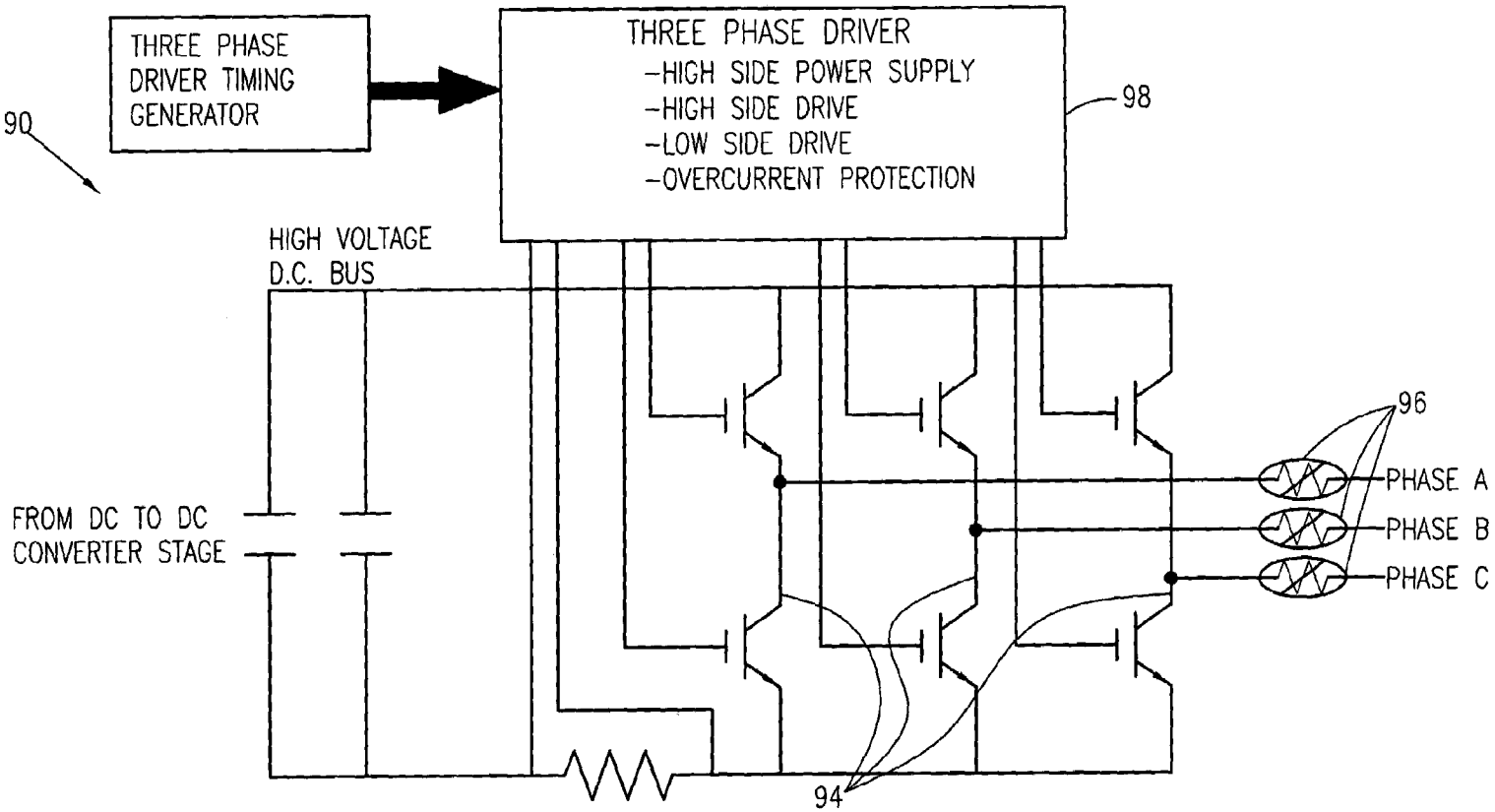
FIG. 6 is a circuit diagram of the three-phase generator of the present invention.

Referring to FIGS. 4-6, the back-up power generation system consists of three areas: 1) a dc battery power system 50; 2) a dc/dc inverter converter 70; and 3) a three phase generator 90.

Referring to FIGS. 2, 4, and 5, the battery power system 50 includes four (4) 12V 12 Ahr batteries 52, a maintenance safety circuit 54, a low battery detection circuit 56, a battery charger system 58, a battery over-current circuit 60, and a main power fuse 62. A 48V system is an optimal design because the system current levels are still at a level where wiring can be used instead of bus bars. Furthermore, even though a higher rated voltage system would reduce the system current levels, such a design would require more batteries and would thus be a more expensive design.

The maintenance safety circuit 54, which further includes a battery disconnect switch 55, prevents the operation of the back-up power system during maintenance operations. The disconnect switch 55 prevents inadvertent operation of the back-up power system while the elevator is locked-out for maintenance. When the disconnect switch 55 is opened, no power is available to the inverter control logic, thus preventing the inverter 70 from being started. The low battery detection circuit 56 protects the lifetime capacity of the batteries 52 by stopping the job cycle lock-out timer 42 if the voltage of the batteries 52 falls too low. The life of a battery is a function of the charge/discharge cycles it sees and how deep (i.e. level of discharge) the cycles are. By controlling the depth of the discharge cycle, the lifetime capacity of the batteries 52 can be maintained.

The battery charging system 58 is provided to permit long term operation of the battery power system 50. This battery charging system 58 is powered from the input line power source and under normal control power provides a current limiting and a voltage limiting charge to the batteries 52. After a job cycle has occurred and normal control power is restored, the battery charging system 58 will initially operate in a current limiting mode with the charging voltage determined by the battery system. As the batteries 52 charge, the battery voltage will rise until the charger's voltage limit is reached and then the charging system 58 operates in a voltage limiting mode until the next job cycle is required.

The battery over-current protection circuit 60 (i.e., overload) provides protection to the backup batteries 52 and prevents the back-up control power system from overheating. The over-current circuit 60 consists of a DC hall effect high frequency current sensor that performs cycle by cycle current level sensing. If the current level exceeds the safe level for the battery power system 50, the over-current circuit 60 will shutdown the inverter 70. However, the battery over-current circuit 60 will only operate if an inverter primary FET control circuit 72 is operational. Therefore, if either the FET 78 or the inverter primary FET control circuit 72 fail, the battery over-current protection 60 system may not function correctly. Therefore, a main battery fuse 62 is provided to protect the battery system against a FET 78 failure. Operation of the primary FET control circuit 72 will be subsequently described.

Referring to FIG. 5, the configuration of the dc/dc inverter converter 70 was selected to optimize the simplicity of the design. The inverter 70 consists of a primary FET H-bridge configuration control circuit 72 having and a high ripple current compatible film capacitor system 76. The FET circuit 72 comprises field effect transistors (FET's) 78 and RC snubber circuits 80. The FET circuit 72 is utilized to drive a main transformer 82 and utilize its leakage inductance to provide a current ramp limiting power source for a secondary 84 of the main transformer 82. The secondary 84 is connected to a high speed full bridge rectifier 86 combined with a low resistance capacitor bank 88. The pulse width of the main transformer 82 and primary FET circuit 72 are controlled via a voltage feedback system that controls the DC bus voltage. To allow safe maintenance operations on the unit, the high voltage dc bus is automatically discharged whenever normal control power is restored or when the unit is switched off. In addition, the inverter 70 will pre-charge the dc bus capacitors of the capacitor bank 88 before the inverter 70 is connected to the elevator system. This allows for a soft-start of the inverter 70 and for the voltage feedback system to stabilize. An over-temperature circuit 89 is provided to protect the power FET's 78 from experiencing too high a temperature. To prevent this from occurring, the temperature of the heat sink monitored. If the temperature of the heat sink exceeds 80 C, the job cycle lock-out timer 42 is stopped and the inverter 70 is shutdown.

In choosing a FET 78, several properties must be met. First, the FET 78 must have a sufficiently low Rdson so as to not generate a large amount of heat while switching the large primary battery currents. Second, the FET 78 must be packaged such that heat can be efficiently removed. Third, the FET 78 must have a voltage rating that sufficiently exceeds the battery system voltage so as to minimize the occurrences of avalanching the protection diode. Fourth, the FET 78 must switch quickly to allow for operation of the main transformer 82 at a frequency that will reduce its size via reducing the volt-seconds applied to the main transformer 82. Finally, the FET 78 must have a current rating compatible with the anticipated battery current levels. One example of a FET 78 that meets these properties is the low Rdson, SOT227 packaged, high voltage rated, high speed device.

During operation, while the battery power system 50 provides the overall back-up power for the elevator system, a high frequency power source and storage source are required. The inverter 70 needs to quickly establish a current and also quickly shed a current. A capacitor system 76 supports this by allowing the majority of the ac current required by the inverter 70 to be sourced from the capacitors of the capacitor system 76. In addition, during the period of time (i.e., dead time) when no current is flowing in the main transformer 82, the leakage inductance of the system will cause power to flow back toward the batteries 52. Without the capacitor system 76, the current would flow to the batteries 52 thereby reducing their lifetime and capacity. Therefore, the capacitor system 76 also further optimize life of the battery system.

In addition, the capacitor system 76 support optimization of the FET's 78 and RC snubbers 80. When power flow into the main transformer 82 is stopped during a dead time, a high flyback voltage can occur. This voltage can be high enough to avalanche the power FET 78 integral protection diodes. While the devices chosen for this design are compatible with this type of operation, the avalanching causes a large instantaneous power dissipation as well as increasing the power loss for the system. The capacitor system 76 minimize this flyback voltage by providing a low resistance power storage source. Thus, once the leakage inductance has a flyback voltage of the capacitor voltage plus the forward diode drops of the FET, the voltage is clamped by the ability of the capacitor system 76 to quickly absorb this energy. This allows a portion of the energy stored in the leakage inductance of the main transformer 82, that would otherwise be wasted, to be recovered. In addition, the RC snubber circuits 80 further slow down the flyback voltage.

Figure 7:
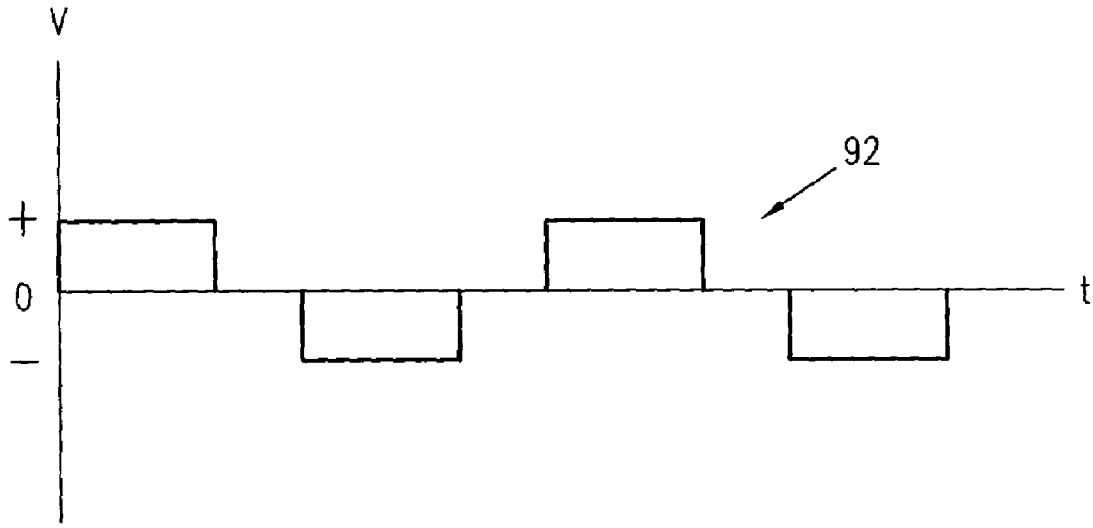
FIG. 7 is a drawing showing the output square wave generated by the present invention.

Referring to FIG. 6, the back-up power generation system includes a three phase generator 90 that takes the dc bus voltage and sequentially switches it such that it generates three stepped square wave outputs. One example of a sequentially stepped square wave output 92 is shown in FIG. 7. The cycle for this example is 5 milliseconds at high voltage, 3 milliseconds at no voltage, 5 milliseconds at negative high voltage, and 3 milliseconds at no voltage. This waveform requires a DC bus voltage of approximately 520 VDC to generate a 400 VAC rms output. The peak voltage of 520 VDC is well below the peak voltage of 560 Vrms of a sine wave and thus safe for most systems.

The three phase generator 90 comprises three half bridge Insulated Gate Bipolar Transistors (IGBT's) systems 94. The IGBT's 94 provide a correct 120 degree phasing between any two phases. The generator 90 further includes surge limiting by using NTC thermistors 96. The thermistors 96 limit the initial load surge current required to charge-up the capacitance and transformers in the back-up power generation system. However, after a short period of time, the thermistors 96 reduce their current limiting and support normal operation of the system with minimal losses. An output over-current protection 98 (i.e., fault) is provided at the output of the three phase generator 90 and provides two levels of protection. First, because the IGBT's 94 have a short circuit time rating and a maximum current rating that should not be exceeded, the over-current protection 98 will shutdown the output stage of the generator 90 if the maximum short duration output current limit is exceeded for a short period (i.e., micro-seconds). Second, to prevent an overload condition on the output of the generator 90, the over-current protection 98 will shutdown the generator 90 if the output current level exceeds an adjustable limit for a predetermined period of time (i.e., within milli-seconds). Finally, the generator 90 may further contain output fuses as a back-up to the output over-current protection 98 in the event that the over-current protection 98 does not function correctly.

The simplicity of this device, its simple interface with the rest of the elevator system, and its single box self contained design make it unique. Other devices require a much higher degree of interconnecting wires and system integration to work correctly. This back-up power system 10 requires installing only six power cables (i.e., three power wires into the unit, three power wires out), the two safety circuit wires to the main disconnect, and the two wires for signaling the elevator controller to initiate a rescue operation.

While the invention has been described with reference to specific embodiments, various changes may be made and equivalents may be substituted for elements thereof by those skilled in the art without departing from the scope of the invention. In addition, other modifications may be made to adapt a particular situation or method to the teachings of the invention without departing from the essential scope thereof.

What is claimed is:

1. A back-up power system for a traction elevator comprising:

a power loss sensing device, wherein the power loss sensing device senses a power irregularity of normal control power;

an inverter timing system operatively connected to the power loss sensing device, wherein the inverter timing system receives a power irregularity signal from the power loss sensing device; and a back-up power generating means communicating with the inverter timing system, wherein the back-up power generating means generates an output to provide back-up power, wherein the inverter timing system includes a job cycle lockout timer, which limits an amount of time that the back-up power generating means supplies output power and ensures operation of a full elevator cycle prior to returning to normal control power; and a main power lockout timer, which prevents simultaneous operation of the back-up power system and normal control power.

2. The backup power system of claim 1, wherein the back-up power generating means further comprises:

a dc battery power system;

a dc/dc converter operatively connected to the output of the dc battery power system; and a three-phase generating means operatively connected to an output of the dc/dc converter, wherein the generating means generates an output consisting of a plurality of square wave outputs.

3. The backup power system of claim 2, wherein the dc battery power system further comprises:

at least one dc battery; and a battery charger system operatively connected to the batteries, wherein the charger system charges the dc battery under normal control power operation.

4. The back-up power system of claim 2, wherein the dc/dc converter further comprises:

a capacitor system to provide an ac current source to the converter;

a transformer, wherein a secondary of the transformer is operatively connected to a bridge rectifier and a low resistance capacitor bank to provide a dc voltage to the back-up generating means; and an H-bridge configuration FET circuit to drive the transformer.

5. The back-up power system of claim 2, wherein the threephase generating means further comprises at least one half bridge IGBT system, wherein the IGBT system provides a 120 degree phasing between any two square wave outputs.

6. The back-up power system of claim 1, wherein the power sensing device is a reverse phase relay.

7. A back-up power system for a traction elevator comprising:

a power loss sensing device, wherein the power loss sensing device senses a power irregularity of normal control power;

an inverter timing system operatively connected to the power loss sensing device, wherein the inverter timing system receives a power irregularity signal from the power loss sensing device; and a back-up power generating means communicating with the inverter timing system, wherein the back-up power generating means generates an output to provide back-up power, the back-up power generating means including:

a dc battery;

a dc/dc converter operatively connected to the battery, wherein the dc/dc converter includes an H-bridge inverter connected to a single-phase transformer and a rectifier connected to a secondary winding of the single-phase transformer; and a three-phase generating means operatively connected to an output of the dc/dc converter.

8. The back-up power system of claim 7, wherein the inverter timing system includes:

a job cycle lockout timer, which limits an amount of time that the back-up power generating means supplies output power and ensures operation of a full elevator cycle prior to returning to normal control power; and a main power lockout timer, which prevents simultaneous operation of the back-up power system and normal control power.

* * * * *